US008827419B2

(12) United States Patent
Nakagawa et al.

(10) Patent No.: US 8,827,419 B2
(45) Date of Patent: Sep. 9, 2014

(54) PRINTING APPARATUS AND CONTROL METHOD THEREFOR

(71) Applicant: Canon Kabushiki Kaisha, Tokyo (JP)

(72) Inventors: Yoshinori Nakagawa, Kawasaki (JP); Yuji Konno, Kawasaki (JP); Tomoki Yamamuro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/864,601

(22) Filed: Apr. 17, 2013

(65) Prior Publication Data

US 2013/0300798 A1 Nov. 14, 2013

(30) Foreign Application Priority Data

May 8, 2012 (JP) ..... 2012-107037
Apr. 8, 2013 (JP) ..... 2013-080841

(51) Int. Cl.
*B41J 2/165* (2006.01)

(52) U.S. Cl.
CPC ..... *B41J 2/1652* (2013.01); *B41J 2/16523* (2013.01)
USPC ..... 347/30; 347/9

(58) Field of Classification Search
CPC ..... B41J 2/1652; B41J 2/16523
USPC ..... 347/6, 9, 21, 28–31, 35
See application file for complete search history.

(56) References Cited

U.S. PATENT DOCUMENTS 6,530,642 B1 3/2003 Uchikata et al.
6,648,447 B2 11/2003 Sugimoto et al.
6,984,009 B2 1/2006 Nakagawa et al.
7,011,386 B2 3/2006 Iwasaki et al.
7,014,292 B2 3/2006 Yazawa et al.
7,029,092 B2 4/2006 Edamura et al.
7,270,409 B2 9/2007 Iwasaki et al.
7,395,778 B2 7/2008 Iwasaki et al.
7,396,095 B2 7/2008 Nakagawa et al.
7,506,953 B2 * 3/2009 Edamura et al. ..... 347/22
7,556,339 B2 7/2009 Nakagawa et al.
7,588,639 B2 9/2009 Iwasaki et al.
7,703,879 B2 4/2010 Yazawa et al.
8,087,744 B2 1/2012 Nakagawa et al.
2011/0227980 A1 * 9/2011 Saitoh et al. ..... 347/14

FOREIGN PATENT DOCUMENTS

JP 02-198861 A 8/1990
JP 2002-137419 A 5/2002
JP 2004-090233 A 3/2004

* cited by examiner

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

An embodiment of the invention has been made to prevent an ink discharge failure or ink mixing caused by preliminary discharge executed with the ink discharge surface of a printhead capped. In the embodiment, to an inkjet printhead in which nozzle arrays are aligned in a direction different from that in which a plurality of nozzles are aligned the following preliminary discharge processing is executed. A cap including a suction port and an air communication port caps the ink discharge surface. After that, a suction recovery unit is driven, thereby performing preliminary discharge for nozzles, among the nozzles of the nozzle arrays, with a long distance to a straight line connecting the suction port with the air communication port before preliminary discharge for nozzles with a short distance to the straight line.

16 Claims, 13 Drawing Sheets

PRINTING APPARATUS AND CONTROL METHOD THEREFOR

BACKGROUND OF THE INVENTION

1. Field of the Invention

The present invention relates to a printing apparatus and a control method therefor and, particularly, to a printing apparatus including an inkjet printhead and an inkjet printhead control method used in the apparatus.

2. Description of the Related Art

Among printing apparatuses which are used as printing means for images, characters, and the like in a printer, copying machine, or facsimile apparatus, inkjet printing apparatuses (to be simply referred to as printing apparatuses hereinafter) perform printing by discharging ink from an inkjet printhead (to be simply referred to as a printhead hereinafter) onto a printing medium.

The printing apparatuses are roughly classified into a serial type printing apparatus which performs printing while scanning the printhead in a direction intersecting the conveyance direction of the printing medium, and a line type printing apparatus which performs printing while holding, at a fixed position, a full-line printhead having a print length corresponding to the full width of the printing medium. The above-described serial type printing apparatus generally sets a printing medium at a predetermined position, and repeats reciprocal movement of a carriage including the printhead in a predetermined direction on the printing medium and paper conveyance by a predetermined amount, thereby printing images on the entire surface of the printing medium.

A printing apparatus which supports color printing and has an arrangement including a plurality of printheads each corresponding to one ink color has become widespread.

A printing apparatus generally includes a recovery unit which removes thickened ink within a nozzle of a printhead and dust attached to the ink discharge surface of the printhead, and maintains stable ink discharge by operating this unit. An example of a recovery operation is an ink discharge operation (preliminary discharge operation) without printing on a printing medium, which enables to discharge thickened ink. The recovery unit includes, for example, a cap member which caps the ink discharge surface of the printhead while no printing is performed in order to prevent drying and evaporation of ink, and a suction pump which sucks thickened ink and the like from a nozzle of the printhead via the cap member.

If a suction recovery operation is performed by capping, by one cap, the ink discharge surface of a printhead including a plurality of nozzle arrays each corresponding to one ink color and formed by a plurality of nozzles, inks of the plurality of colors are mixed and refilled in the cap. If the cap member is separated from the ink discharge surface after the suction recovery operation in this state, mixed color ink remaining on the ink discharge surface of the printhead may enter a nozzle, and mix with the ink within the nozzle. Therefore, ink of a color different from an original ink color may be discharged from the printhead, thereby disabling, for example, printing with desired color on the printing medium.

To prevent this problem, for example, Japanese Patent Laid-Open No. 2002-137419 proposes an arrangement in which an air communication port capable of communicating with the outer air is provided in a cap, and the air communication port is communicated with the outer air after a suction operation to perform a preliminary discharge operation while performing the suction operation, thereby discharging mixed color ink.

On the other hand, if a preliminary discharge operation is performed with the printhead separated from the cap, satellites accompanying ink droplets, satellites created when some of ink droplets attached to the cap splash around, or the like float within the printing apparatus, thereby causing an ink mist. To suppress the occurrence of an ink mist, for example, Japanese Patent Laid-Open No. 2004-90233 proposes an arrangement in which if a preliminary discharge operation is performed the number of times equal to or larger than a predetermined value, the preliminary discharge operation is performed within a cap while it contacts the ink discharge surface of a printhead.

If, however, a preliminary discharge operation is performed within a cap while it contacts the ink discharge surface of a printhead as in the above-described conventional example, ink may collect in the cap and the ink liquid surface in the cap may reach near a nozzle. If the preliminary discharge operation continues after the ink liquid surface reaches near the nozzle, ink droplets discharged to the ink liquid surface may create bubbles on the liquid surface of the ink collecting in the cap, and the bubbles may enter the nozzle. This causes a discharge failure, thereby decreasing the quality of printing.

Furthermore, if the ink liquid surface reaches the distal end of the nozzle provided on the ink discharge surface, mixed color ink may enter the nozzle.

SUMMARY OF THE INVENTION

Accordingly, the present invention is conceived as a response to the above-described disadvantages of the conventional art.

For example, a printing apparatus and a control method used in the apparatus according to this invention are capable of preventing a discharge failure or ink mixing while preventing the occurrence of an ink mist even if a preliminary discharge operation is performed many times.

According to one aspect of the present invention, there is provided a printing apparatus comprising: a printhead including a nozzle surface with at least one nozzle array formed by a plurality of nozzles for discharging ink; a cap member for capping the nozzle surface of the printhead, wherein the cap member includes a suction port for sucking ink from the cap member and an inflow port through which air flows in; a suction unit connected to the suction port; and a control unit configured to control, in performing an ink preliminary discharge operation for the printhead while driving the suction unit with the nozzle surface capped by the cap member, start a first preliminary discharge operation for nozzles, among the plurality of nozzles, with a long distance to a straight line connecting the suction port with the inflow port before a second preliminary discharge operation for nozzles with a short distance to the straight line.

According to another aspect of the present invention, there is provided a control method for a printing apparatus which comprises a printhead including a nozzle surface with at least one nozzle array formed by a plurality of nozzles for discharging ink, a cap member for capping the nozzle surface of the printhead, wherein the cap member includes a suction port for sucking ink from the cap member and an inflow port through which air flows in, and a suction unit connected to the suction port, the method comprising: capping the nozzle surface by the cap member; driving the suction unit; and performing an ink preliminary discharge operation for the printhead, wherein in the preliminary discharge operation, a first preliminary discharge operation for nozzles, among the plurality of nozzles, with a long distance to a straight line connecting the suction port with the inflow port starts before a second preliminary discharge operation for nozzles with a short distance to the straight line.

The invention is particularly advantageous since a preliminary discharge operation is performed first for a nozzle which performs a preliminary discharge operation for an area where ink discharge performance within the cap is poor, thereby enabling to complete the preliminary discharge operation before ink collects in the cap. This can prevent an ink discharge failure or ink mixing while preventing the occurrence of an ink mist even if a preliminary discharge operation is performed many times.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<General Outline of Printing Apparatus (FIG. 1)>

Figure 1:
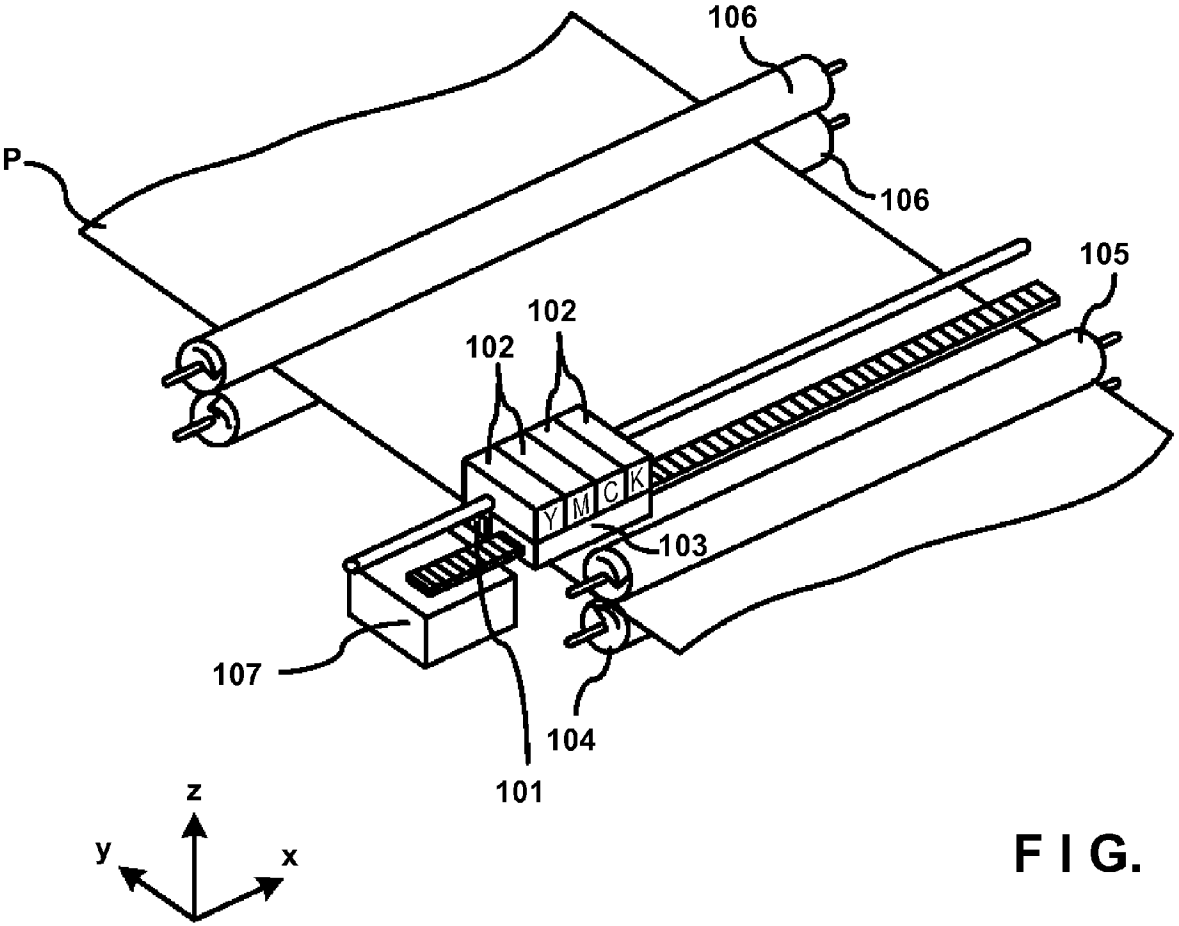
FIG. 1 is a perspective view showing the outer appearance of a printing apparatus for performing printing using an inkjet printhead as an exemplary embodiment of the present invention.

FIG. 1 is a perspective view showing the outer appearance of a printing apparatus for performing printing using an inkjet printhead (to be simply referred to as a printhead hereinafter) as an exemplary embodiment of the present invention.

As shown in FIG. 1, a printhead 101 is attached to a carriage 103, and supplied with inks from individual ink tanks 102 of four colors: black (K), cyan (C), magenta (M), and yellow (Y). Each ink tank 102 is individually exchangeable, and holds ink by a negative pressure generation mechanism within itself. To exchange the ink tanks 102, the user opens a cover (not shown) provided in the opening of the printing apparatus which enables to access the ink tanks.

The carriage 103 reciprocates in a main scanning direction (x direction in FIG. 1) by a carriage motor (not shown). Referring to FIG. 1, reference symbol P denotes a printing medium. Printing for a width corresponding to one scanning operation is completed by scanning of the carriage 103 in the main scanning direction and discharge of ink droplets by the printhead 101. Upon completion of printing for a width corresponding to one scanning operation, the printing medium P clamped between a conveyance roller 104 and a pinch roller 105 is conveyed in the y direction (sub-scanning direction) in FIG. 1 by rotation of the conveyance roller 104 caused by a conveyance motor (not shown).

Furthermore, the printing medium P is clamped by a pair of paper discharge rollers 106 on the downstream side in the conveyance direction (the y direction in FIG. 1), and a tension is generated between the clamping portion by the pair of paper discharge rollers 106 and that by the conveyance roller 104 and pinch roller 105. The printing apparatus completes printing for one page by scanning of the carriage 103 in the main scanning direction, ink droplet discharge from the printhead 101, and conveyance of the printing medium by the conveyance roller 104.

Note that a maintenance unit (recovery unit) 107 is arranged outside a print area within the moving range of the carriage 103. The maintenance unit 107 includes a wiping mechanism and a suction mechanism.

<Detailed Arrangement Around Carriage (FIGS. 2A and 2B)>

Figure 2B:
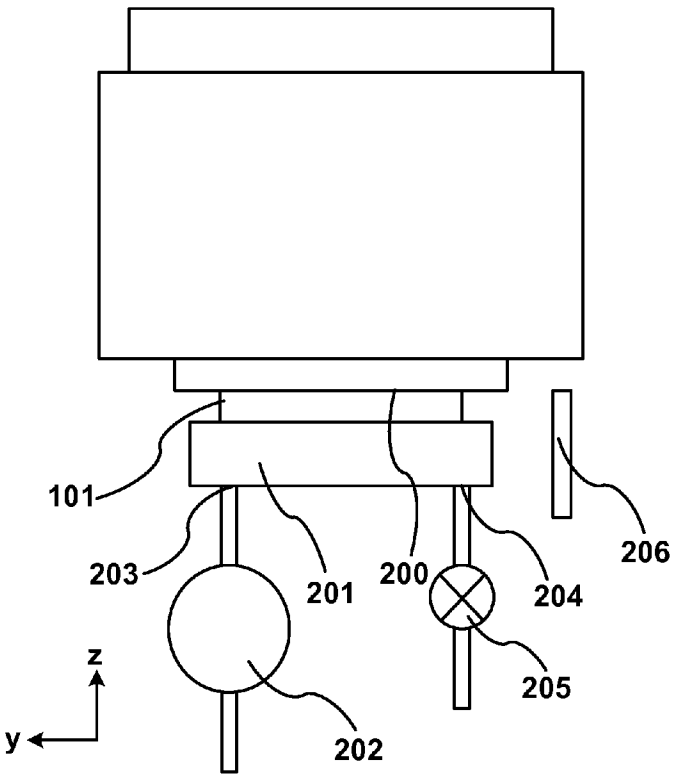
FIGS. 2A and 2B are a partial front view and a side sectional view of a printing apparatus 2 shown in FIG. 1, which show an arrangement around the carriage of the printing apparatus 2.
Figure 2A:
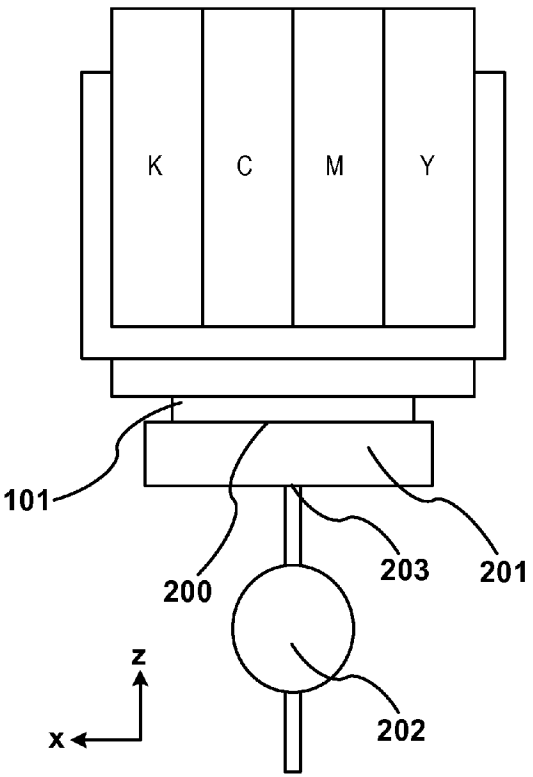

FIGS. 2A and 2B are a partial front view and a side sectional view of a printing apparatus 2 shown in FIG. 1, which show an arrangement around the carriage of the printing apparatus 2.

FIG. 2A is a front view schematically showing the arrangement of the printhead 101 and recovery unit 107 when viewed from the y direction in FIG. 1. FIG. 2B is a side sectional view schematically showing the arrangement of the printhead 101 and recovery unit 107 when viewed from the x direction in FIG. 1.

In a state shown in FIGS. 2A and 2B, a cap 201 caps a nozzle surface (ink discharge surface) 200 of the printhead 101, which includes nozzle arrays corresponding to the respective ink colors of K, C, M, and Y. The cap 201 is movable in the upper-and-lower direction (z direction) by a driving mechanism (not shown), and is used to perform a capping operation and a cap opening operation for the ink discharge surface 200.

As shown in FIG. 2B, a suction port 203 connecting to a suction pump 202 and an air communication port 204 communicating with the outer air are provided on the bottom surface of the cap 201. An air communication valve 205 which can be opened/closed is provided between the air communication port 204 and the outer air. To perform a suction recovery operation for the printhead 101, the cap 201 caps the ink discharge surface 200, the air communication valve 205 is set to a closed state to operate the suction pump 202, and a negative pressure is generated within the cap 201, thereby sucking ink from the nozzle. The ink in the cap after the suction operation is discharged by setting the air communication valve 205 in an open state to operate the suction pump 202, and drawing air from the air communication port 204 while discharging the ink from the cap 201.

A wiper 206 for wiping dust on the ink discharge surface of the printhead 101 is arranged as a wiping mechanism in the recovery unit 107, and wipes ink attached to the ink discharge surface. The wiper 206 wipes ink on the ink discharge surface 200 by moving in the y direction in FIG. 2B by a driving motor (not shown).

<Control Arrangement (FIG. 3)>

A control arrangement for controlling print processing by the printing apparatus described with reference to FIG. 1 will now be explained.

Figure 3:
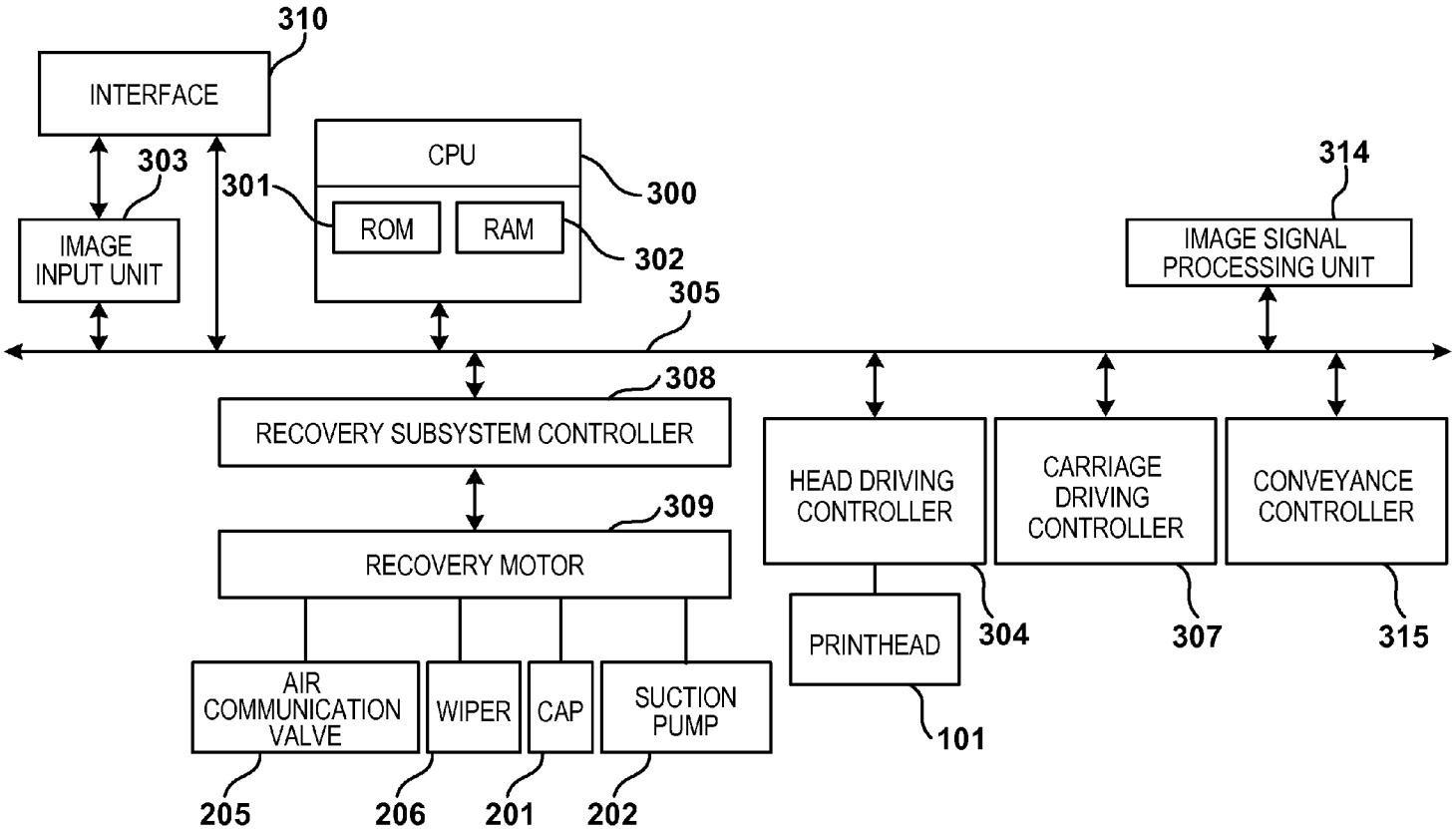
FIG. 3 is a block diagram showing the control arrangement of the printing apparatus shown in FIG. 1.

FIG. 3 is a block diagram showing the control arrangement of the printing apparatus shown in FIG. 1.

Referring to FIG. 3, a CPU 300 controls each component of the apparatus via a main bus line 305, and executes data processing. That is, the CPU 300 executes programs stored in a ROM 301 to execute data processing, control driving of the printhead, and control driving of the carriage via the following respective components, thereby printing an image. The CPU 300 can execute communication processing with a host apparatus via an interface 310.

A RAM 302 is used as a work area for data processing or the like by the CPU 300, and temporarily stores print data for a plurality of scanning and printing operations of the printhead, parameters associated with a recovery processing operation and an ink supply operation by the printing apparatus, and the like. An image input unit 303 temporarily holds image data received and input from the host apparatus via the interface 310.

A recovery subsystem controller 308 controls driving of a recovery motor 309 according to a recovery processing program stored in the ROM 301, and controls a recovery operation such as an up/down operation of the cap 201, the operation of the wiper 206, opening/closing of the air communication valve 205, and the operation of the suction pump 202. A head driving controller 304 controls driving of the printhead 101, and generally causes the printhead 101 to perform a preliminary discharge operation and an ink discharge operation for printing. A carriage driving controller 307 controls scanning of the printhead 101 for a print operation based on print data processed by an image signal processing unit 314 as well as movement to the recovery unit 107 for a suction recovery operation.

Figure 4A:
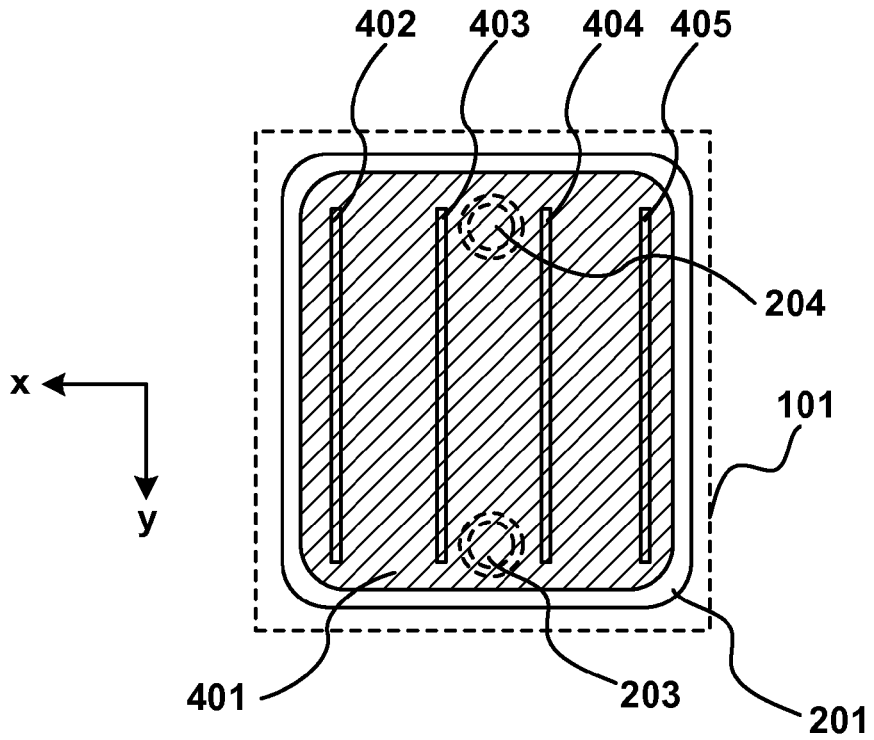
FIGS. 4A and 4B are views each showing the arrangement of a cap provided in a recovery unit.
Figure 4B:
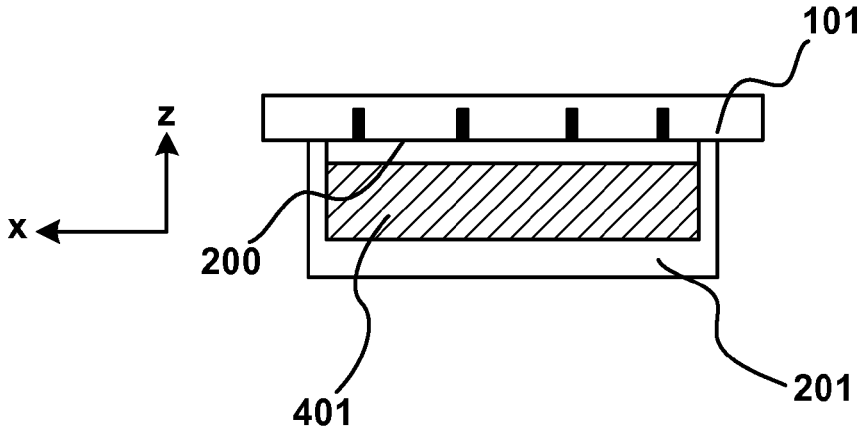

FIGS. 4A and 4B are views each showing the arrangement of the cap provided in the recovery unit.

FIG. 4A is a schematic view showing the bottom of the printhead 101 when viewed in the z direction shown in FIG. 1. FIG. 4B is a side sectional view schematically showing the cap and printhead when viewed in the y direction shown in FIG. 1.

As shown in FIG. 4B, the ink discharge surface 200 is sealed when the cap 201 contacts the ink discharge surface 200 of the printhead 101. The cap 201 includes the suction port 203 and air communication port 204, as shown in FIG. 4A. Furthermore, as shown in FIGS. 4A and 4B, an intracap absorber 401 formed by a porous body is arranged in the cap 201 to contact the suction port 203 and air communication port 204. Referring to FIG. 4A, reference numerals 402 to 405 denote nozzle arrays for discharging black ink (BK ink), cyan ink (C ink), magenta ink (M ink), and yellow ink, respectively. The nozzle array 402, 403, 404, or 405 of each color includes 768 nozzles which are aligned in the y direction. The suction port 203 and air communication port 204 included in the cap 201 are aligned in a direction parallel to the nozzle array direction. Let $L_{BK}$, $L_C$, $L_M$, and $L_Y$ be the distances between the nozzle arrays 402 to 405 and a straight line connecting the suction port 203 with the air communication port 204, respectively. Then, $L_{BK}=L_Y>L_C=L_M$ is satisfied.

The intracap absorber 401 is used to suppress the inflow amount of mixed ink into the nozzles after a suction operation. As is apparent from FIG. 4B, a gap is provided in the z direction to the extent that the intracap absorber 401 does not contact the ink discharge surface 200 in capping. Since mixed ink which has collected in the gap flows into the nozzles after a suction operation, a preliminary discharge operation is performed after the suction operation to discharge mixed ink from the nozzles.

The number of ink droplets by the preliminary discharge operation (the number of discharge operations) which is necessary to discharge mixed ink from the nozzles is 10000 for the nozzles of each color. If the preliminary discharge operation is performed 10000 times while the cap 201 is open, an ink mist spreads within the apparatus. The preliminary discharge operation is thus performed while the cap 201 is closed.

<Standard Preliminary Discharge Sequence (FIG. 5)>

A standard preliminary discharge sequence will be described for comparison with embodiments of the present invention to be described below.

Figure 5:
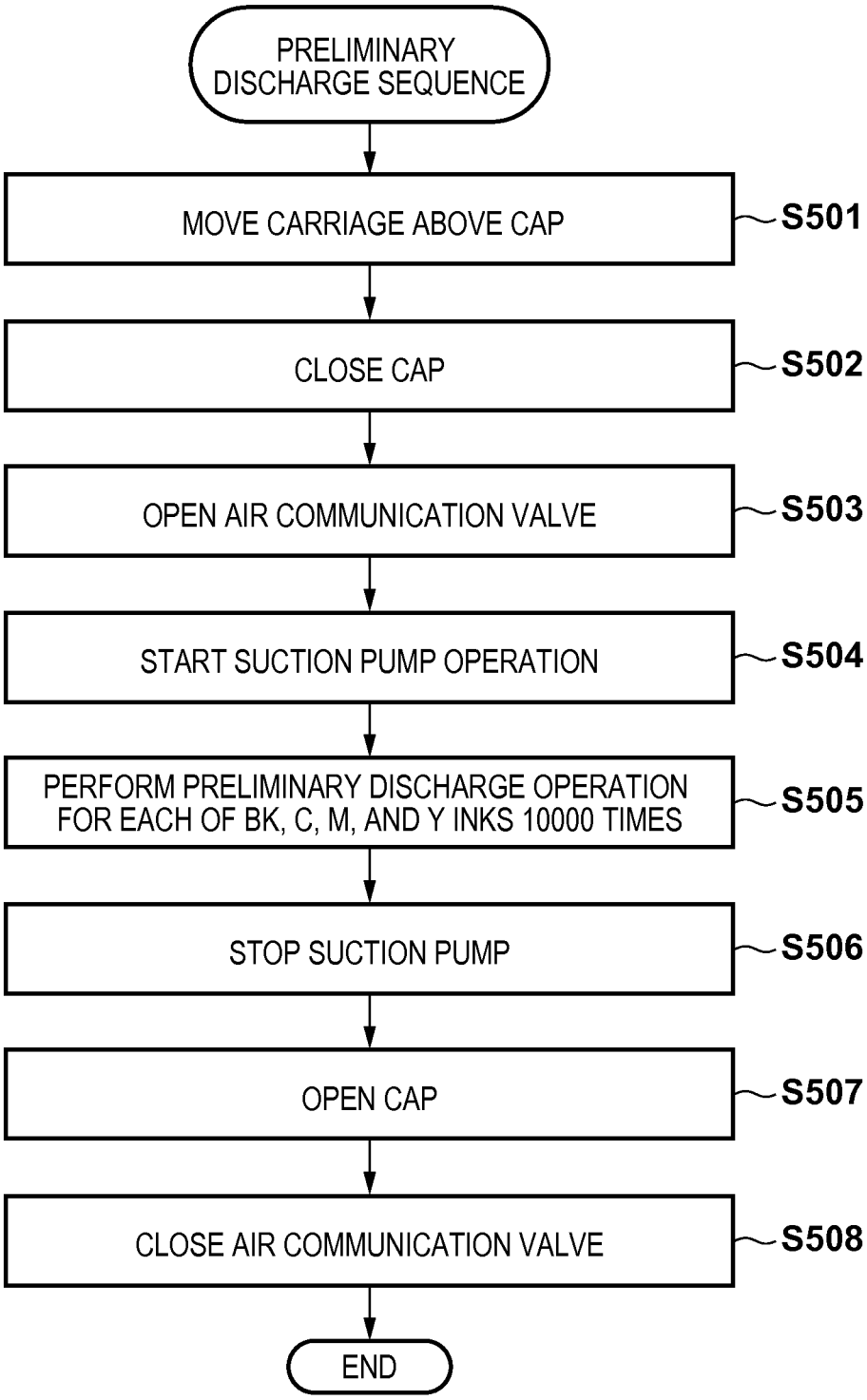
FIG. 5 is a flowchart illustrating a standard preliminary discharge sequence.

FIG. 5 is a flowchart illustrating the standard preliminary discharge sequence.

Referring to FIG. 5, upon start of the preliminary discharge sequence, in step S501 the carriage 103 is moved above the cap provided in the recovery unit 107 to perform a preliminary discharge operation within the cap.

In step S502, the cap 201 is closed to prevent dispersion of an ink mist by the preliminary discharge operation. In step S503, the air communication valve 205 is set in the open state, thereby communicating the outer air from the air communication port 204 to the cap. In step S504, a suction operation starts. At this time, since the air communication valve is in the open state, even if the suction operation generates a negative pressure within the cap, the air communication port serves as an inflow port through which air flows into the cap, thereby disabling to create a negative pressure state in which ink can be sucked from the nozzles.

In step S505, a preliminary discharge operation is simultaneously performed for the respective ink colors 10000 times at a discharge frequency of 10 kHz. Since a suction operation is performed at this time, ink discharged to the cap and air in the cap are discharged to the suction port 203 by a negative pressure. Therefore, no overflow of ink occurs in the air communication port 204.

Upon completion of the preliminary discharge operation in step S505, the suction pump is stopped in step S506, and the cap 201 is opened in step S507. Finally, in step S508, the air communication valve 205 is closed, thereby terminating the preliminary discharge sequence.

Figure 6A:
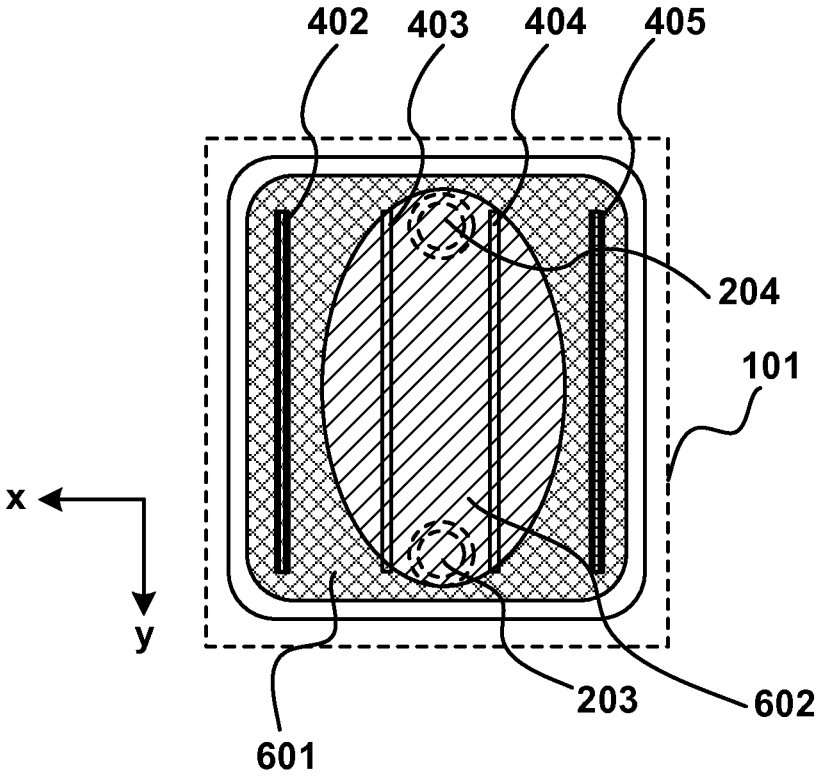
FIGS. 6A and 6B are views each schematically showing a state within the cap while the standard preliminary discharge sequence shown in FIG. 5 is executed.
Figure 6B:
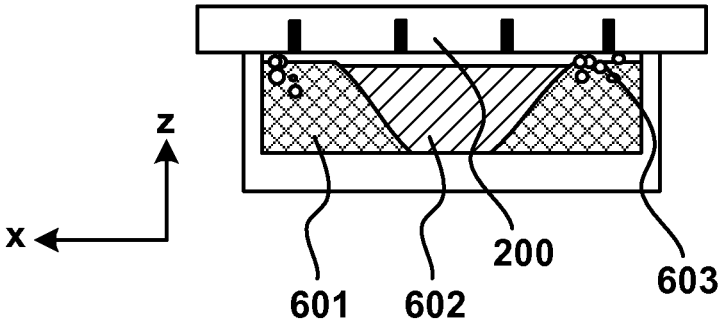

FIGS. 6A and 6B are views each schematically showing a state within the cap while the standard preliminary discharge sequence shown in FIG. 5 is executed. FIG. 6A is a schematic view showing a state within the cap while the standard preliminary discharge sequence is executed, when viewed in the z direction shown in FIG. 1, and also shows the bottom of the printhead 101. FIG. 6B is a schematic view showing a state within the cap while the standard preliminary discharge sequence is executed, when viewed in the y direction shown in FIG. 1.

Referring to FIG. 6A, reference numeral 601 denotes an area where the liquid surface rises above the intracap absorber by the preliminary discharge operation; 602, an area where the liquid surface is below the intracap absorber. The air communication valve 205 is set in the open state to operate the suction pump 202, thereby generating a pressure difference between the air communication port 204 and the suction port 203.

Therefore, the flow of ink easily occurs in a straight line portion connecting the air communication port 204 with the suction port 203 within the cap 201, and in an area where there is small resistance to flow, and thus the ink having collected between the air communication port 204 and suction port 203 is easily discharged from the suction port 203. Referring to FIG. 6B, the area 601 is represented as a crosshatched area, and the area 602 is represented as a shaded area, thereby indicating that there is a difference in liquid surface between the areas.

The flow of ink hardly occurs at a position away from the straight line connecting the air communication port 204 with the suction port 203, and thus ink is hardly discharged. This results in the area 602 where ink is easily discharged, and the area 601 where ink is hardly discharged and the liquid surface rises.

As indicated by FIGS. 6A and 6B, if the preliminary discharge operation continues, the liquid surface may reach the ink discharge surface 200 in the area 601 where the liquid surface rises above the intracap absorber 401. If the liquid surface reaches the nozzles, a negative pressure of the ink tank communicating with the nozzles may cause back-flow of mixed ink in the cap or cause bubbles 603, generated by discharging ink droplets to the liquid surface, to enter the nozzles.

Some embodiments of a preliminary discharge sequence for solving problems caused by execution of the standard preliminary discharge sequence will be described.

First Embodiment

Figure 7:
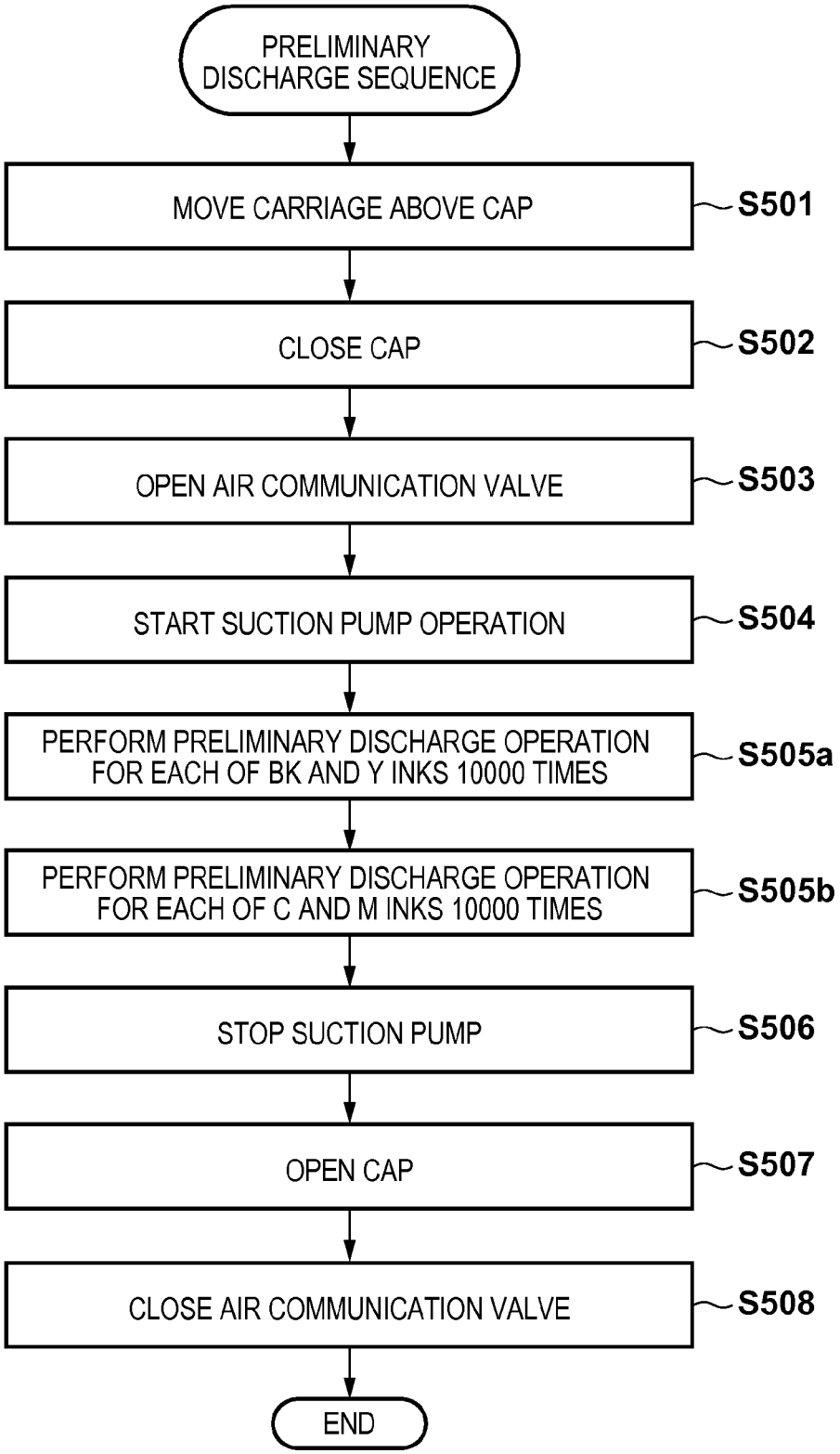
FIG. 7 is a flowchart illustrating a preliminary discharge sequence according to the first embodiment.

FIG. 7 is a flowchart illustrating a preliminary discharge sequence according to the first embodiment. Note that in FIG. 7, the same processing steps as those already described with reference to FIG. 5 have the same reference symbols, and a description thereof will be omitted.

In step S505*a*, a preliminary discharge operation is performed for a nozzle array 402 for discharging black ink (BK ink) and a nozzle array 405 for discharging yellow ink (Y ink) immediately above an area (an area 601 in FIG. 6A) where ink is hardly discharged.

In step S505*b*, a preliminary discharge operation is performed for a nozzle array 403 for discharging cyan ink (C ink) and a nozzle array 404 for discharging magenta ink (M ink) immediately above an area (an area 602 in FIG. 6A) where ink is easily discharged.

As described above, the preliminary discharge operation for BK ink and Y ink precedes that for C ink and M ink, thereby performing a preliminary discharge operation starting form a nozzle array near the area where ink is hardly discharged while no ink collects in the cap by a preliminary discharge operation. This sequence enables to complete the preliminary discharge operation before the ink liquid surface rises, thereby preventing back-flow of mixed ink in the cap into the nozzles or entering of bubbles.

Note that in the above-described example, a preliminary discharge operation is simultaneously performed first for the nozzle arrays for discharging BK ink and Y ink which are farthest from a straight line connecting an air communication port with a suction port. The present invention, however, is not limited to this. For example, the foaming properties of BK ink and Y ink may be compared with each other, and a preliminary discharge operation may be performed first for ink with a higher foaming property.

According to the above-described embodiment, therefore, it is possible to perform a preliminary discharge operation starting from nozzles existing in an area where there is large resistance to flow in an ink channel from the air communication port to the suction port within the cap, that is, an area away from the straight line connecting the air communication port with the suction port. This can prevent back-flow of mixed ink in the cap into the nozzles, or entering of bubbles.

Second Embodiment

A case in which the straight line connecting the air communication port with the suction port is parallel to the nozzle arrays has been explained in the first embodiment. In the second embodiment, a case in which a straight line connecting an air communication port with a suction port is perpendicular to nozzle arrays will be described.

Figure 8:
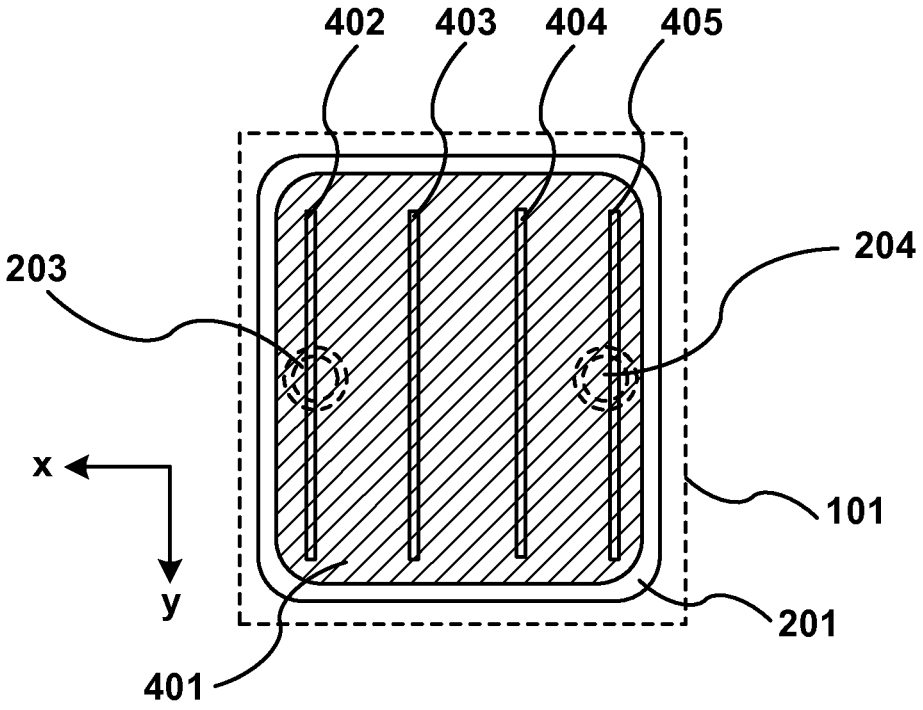
FIG. 8 is a schematic view showing the relationship between a cap and the nozzle arrays of a printhead according to the second embodiment.

FIG. 8 is a schematic view showing the relationship between a cap and the nozzle arrays of a printhead according to the second embodiment. Note that in FIG. 8, the same components as those already described with reference to FIG. 4 have the same reference numerals, and a description thereof will be omitted. As is apparent from FIG. 8, an air communication port 204 and a suction port 203 are aligned in the x direction which is perpendicular to nozzle arrays 402 to 405 in each of which nozzles are aligned in the y direction.

Figure 9:
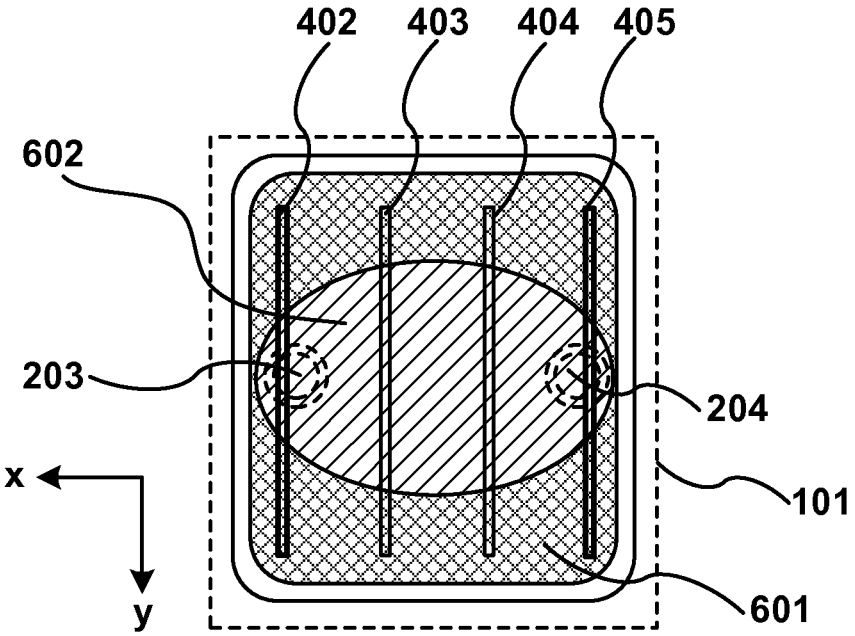
FIG. 9 is a view schematically showing a state within the cap while a preliminary discharge sequence is executed according to the second embodiment.

FIG. 9 is a view schematically showing a state within the cap while a preliminary discharge sequence according to the second embodiment is executed. Referring to FIG. 9, the same components as those already described with reference to FIG. 6 have the same reference numerals, and a description thereof will be omitted.

In the arrangement shown in FIG. 9, the flow of ink hardly occurs at a position away from the straight line connecting the air communication port 204 with the suction port 203 and thus ink is hardly discharged, similarly to the example shown in FIG. 6. This results in an area 602 where ink is easily discharged, and an area 601 where ink is hardly discharged and the liquid surface rises.

Figure 10:
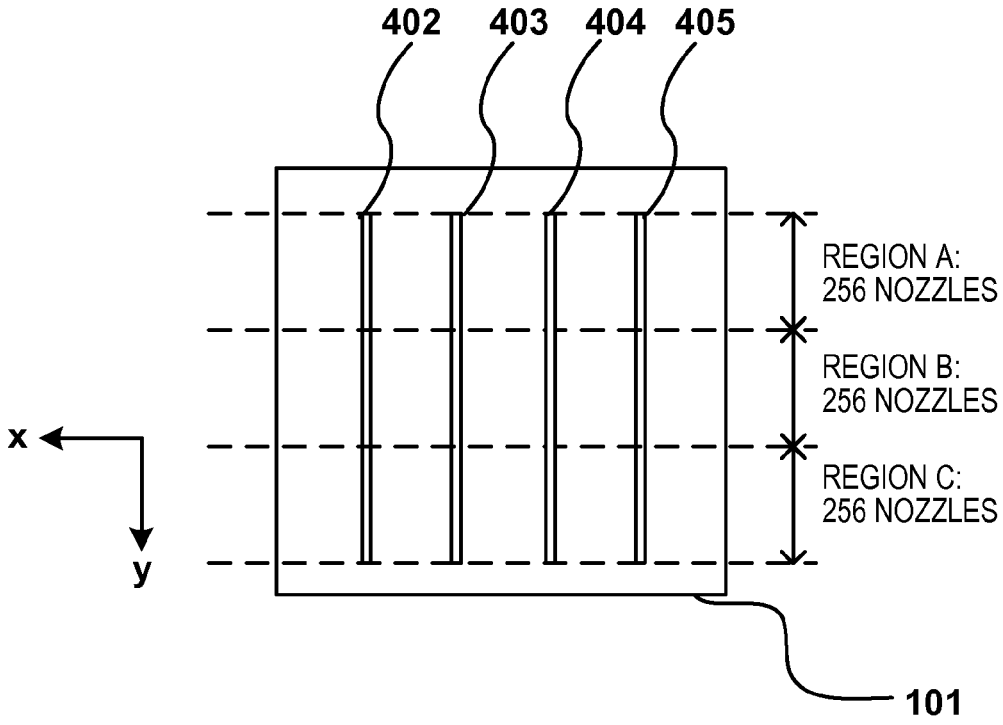
FIG. 10 is a schematic view showing the preliminary discharge division areas of the printhead associated with the preliminary discharge sequence according to the second embodiment.

FIG. 10 is a schematic view showing the preliminary discharge division areas of the printhead associated with the preliminary discharge sequence according to the second embodiment.

As shown in FIG. 10, the nozzle array 402, 403, 404, or 405 including 768 nozzles is divided into three areas in the y direction, and a head driving controller 304 can individually perform a preliminary discharge operation for the nozzles in each divided area. Each nozzle array is equally divided into three areas, and the number of nozzles corresponding to each area of each nozzle array is 256. Each divided area includes neighboring nozzles, and the divided areas are referred to as region A, region B, and region C in the y direction.

Figure 11:
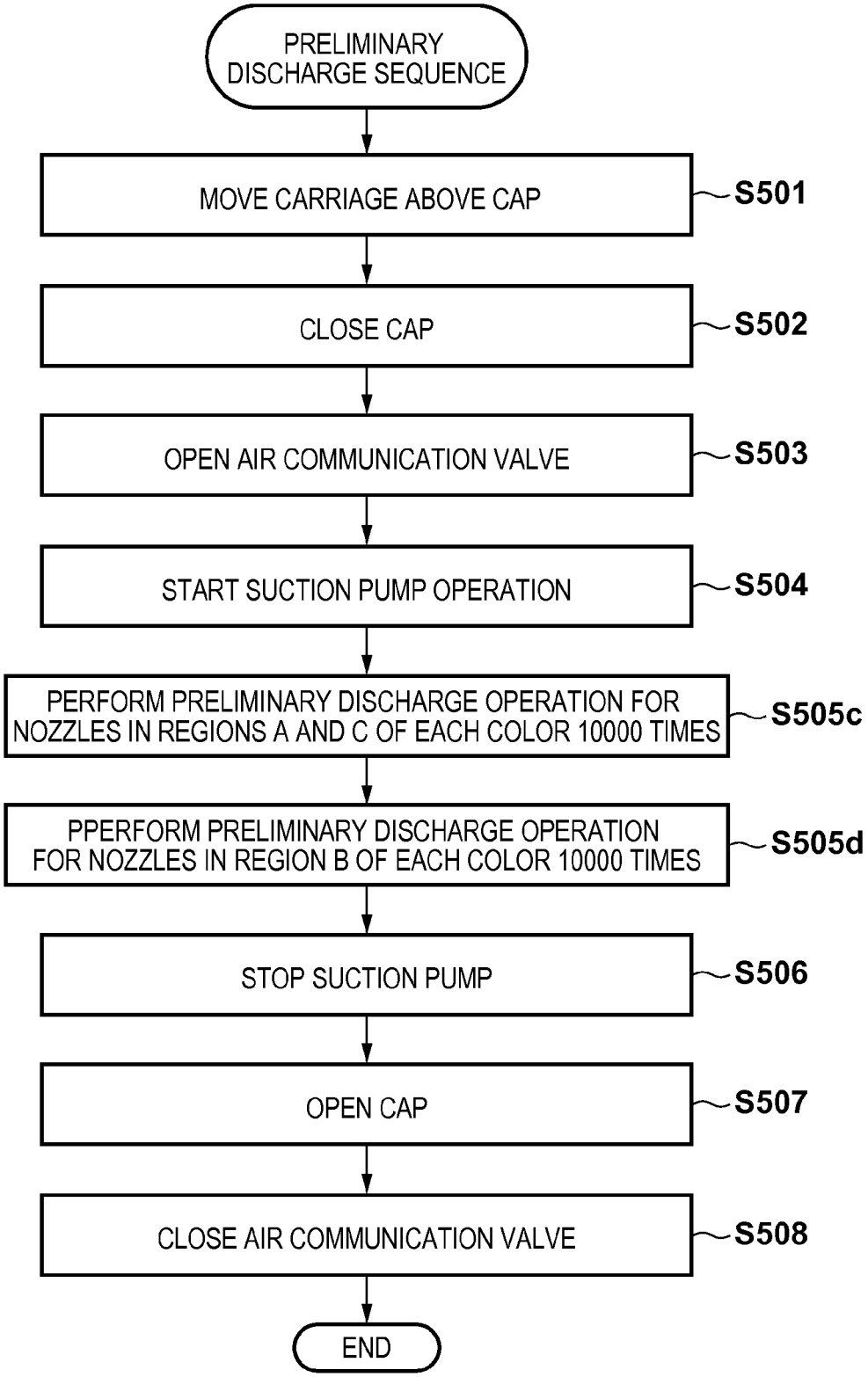
FIG. 11 is a flowchart illustrating the preliminary discharge sequence according to the second embodiment.

FIG. 11 is a flowchart illustrating the preliminary discharge sequence according to the second embodiment. Note that in FIG. 11, the same processing steps as those already described with reference to FIG. 5 have the same reference symbols, and a description thereof will be omitted.

In step S505*c*, a preliminary discharge operation is performed for the nozzles in regions A and C of each nozzle array immediately above the area where ink is hardly discharged. In step S505*d*, a preliminary discharge operation is performed for the nozzles in region B of each nozzle array. Note that the driving frequency of the preliminary discharge operation and the number of preliminary discharge operations are the same as those in steps S505*a* and 505*b* in the first embodiment.

As described above, the preliminary discharge operation for the nozzles in regions A and C of each nozzle array precedes that for the nozzles in region B of each nozzle array, thereby enabling to perform a preliminary discharge operation for the nozzles in the area where ink is hardly discharged while no ink collects in the cap by a preliminary discharge operation.

As in the first embodiment, this sequence enables to complete the preliminary discharge operation before the ink liquid surface rises, thereby preventing back-flow of mixed ink in the cap into the nozzles or entering of bubbles.

Third Embodiment

In the first and second embodiments, the cap includes the air communication port. In the preliminary discharge operation while capping, the air communication valve is set in an open state to drive the suction pump, thereby executing the preliminary discharge operation while discharging ink. In the third embodiment, a case in which a minute opening obtained by tilting a cap is used as an air communication portion instead of the air communication port will be described.

Figure 12A:
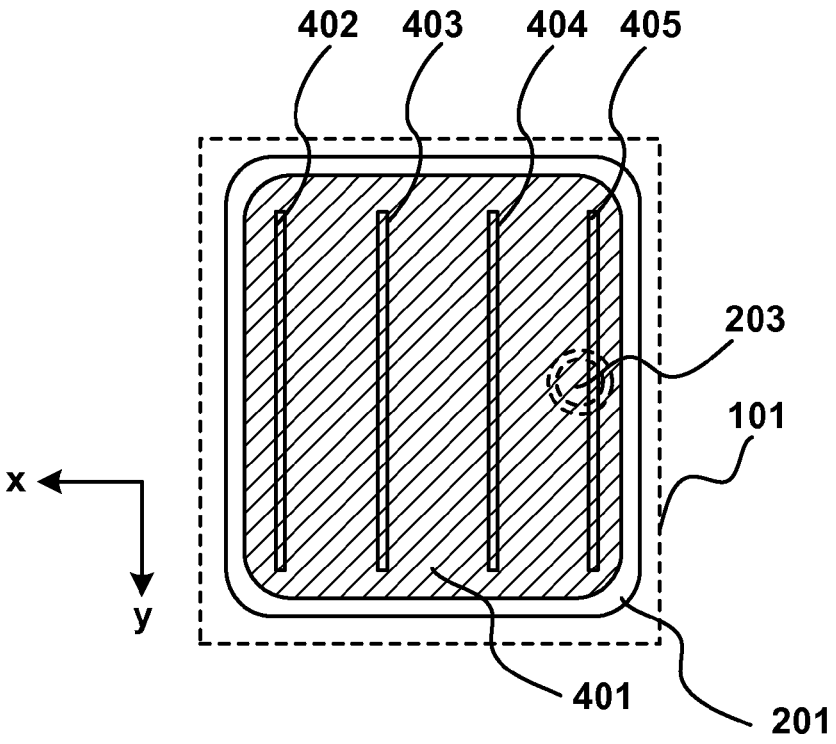
FIGS. 12A and 12B are views each showing the arrangement of a cap provided in a recovery unit.
Figure 12B:
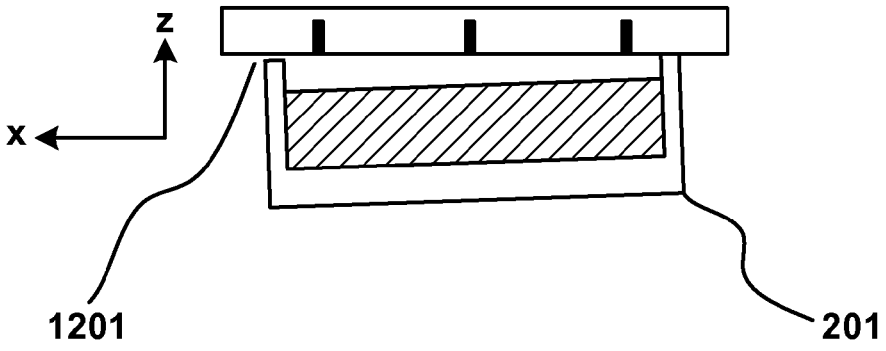

FIGS. 12A and 12B are views each showing the arrangement of the cap provided in a recovery unit.

FIG. 12A is a schematic view showing the bottom of a printhead 101 when viewed in the z direction shown in FIG. 1. FIG. 12B is a side sectional view schematically showing the cap and printhead when viewed in the y direction shown in FIG. 1. FIG. 12A also shows the projection of the nozzle arrays of the printhead 101 for descriptive convenience. Note that in FIGS. 12A and 12B, the same components as those already described with reference to FIGS. 4A and 4B have the same reference numerals, and a description thereof will be omitted.

As will be apparent by comparing FIG. 12A with FIG. 4A, a cap 201 according to this embodiment includes no air communication port but one edge portion in the x direction of the cap 201 can be tilted downward instead, as shown in FIG. 12B. The vertical movement driving mechanism of the cap 201 can not only move the cap in a direction perpendicular to the z-axis but also tilt one edge portion in the x direction of the cap 201 downward from a capping position.

If one edge portion of the cap 201 is tilted as shown in FIG. 12B, the cap edge portion opposite to a suction port 203 in the x direction communicates with the outer air, thereby forming an air communication port. In this embodiment, the operation of tilting the cap will be referred to as an air communication operation, and a portion which communicates with the outer air by the air communication operation will be referred to as an air communication portion 1201.

In this embodiment, as in the second embodiment, it is possible to individually perform a preliminary discharge operation for each of three areas obtained by dividing each nozzle array in the y direction.

Figure 13:
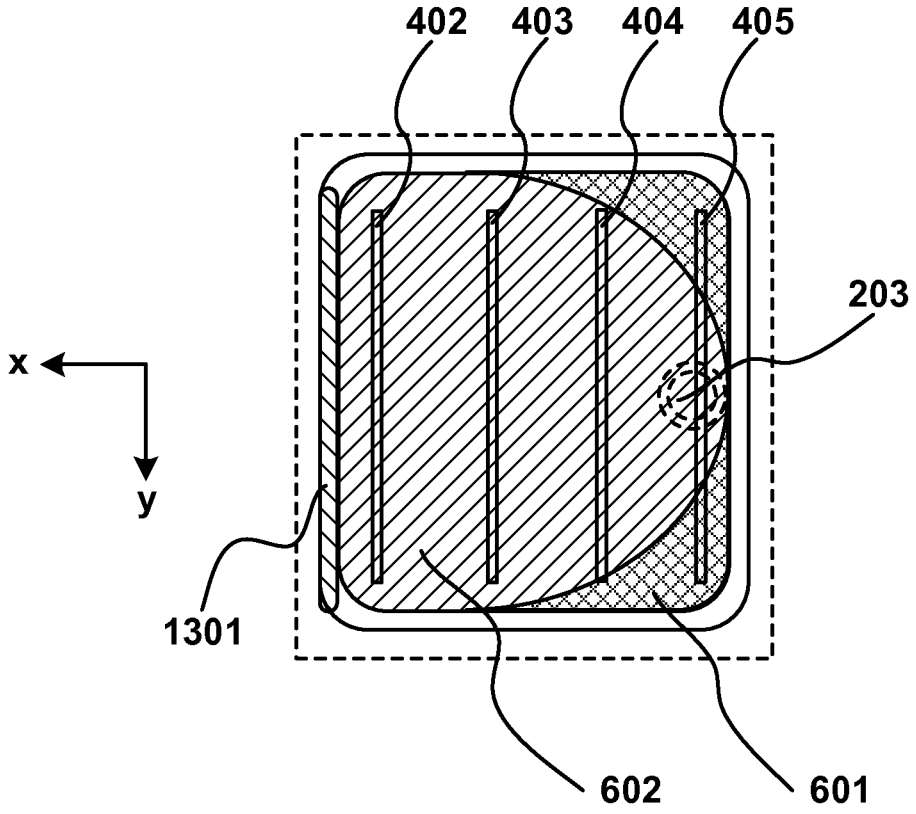
FIG. 13 is a view schematically showing a state within the cap while a preliminary discharge sequence is executed according to the third embodiment.

FIG. 13 is a view schematically showing a state within the cap while a preliminary discharge sequence according to the third embodiment is executed. In FIG. 13, the same components as those already described with reference to FIG. 6 have the same reference numerals, and a description thereof will be omitted.

Referring to FIG. 13, an area 601 where the liquid surface rises above an intracap absorber and an area 602 where the liquid surface is below the intracap absorber exist due to the preliminary discharge operation, similarly to FIG. 6, although the positions of the areas are different from those shown in FIG. 6. In an area where there is large resistance to flow in a path from an air communication portion 1301 to the suction port 203, the flow of ink hardly occurs and thus ink is hardly discharged. This results in the area 602 where ink is easily discharged and the area 601 where ink is hardly discharged and the liquid surface rises.

Figure 14:
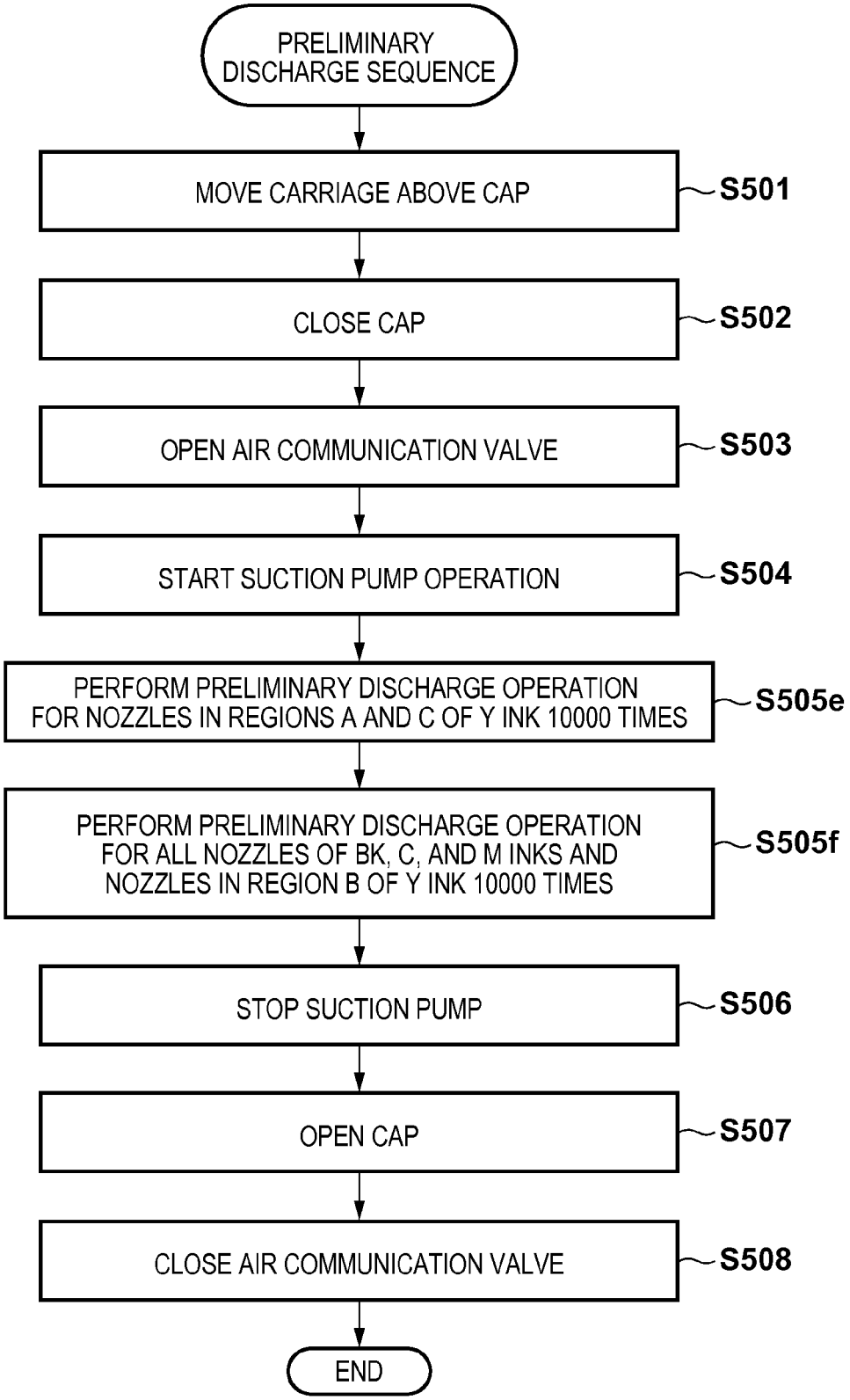
FIG. 14 is a flowchart illustrating the preliminary discharge sequence according to the third embodiment.

FIG. 14 is a flowchart illustrating the preliminary discharge sequence according to the third embodiment. Note that in FIG. 14, the same processing steps as those already described with reference to FIG. 5 have the same reference symbols, and a description thereof will be omitted.

In step S505*e*, the preliminary discharge operation is executed for the nozzles in regions A and C of a nozzle array 405 for discharging Y ink immediately above the area where ink is hardly discharged. In step S505*f*, the preliminary discharge operation is executed for all the nozzles of nozzle arrays 402 to 404 for discharging BK ink, C ink, and M ink, respectively, and the nozzles in region B of the nozzle array 405. Note that the driving frequency of the preliminary discharge operation and the number of preliminary discharge operations are the same as those in steps S505*a* and 505*b* in the first embodiment.

As described above, the preliminary discharge operation for the nozzles in regions A and C of the nozzle array for discharging Y ink precedes that for the nozzles in region B of the same nozzle array and the nozzles of other nozzle arrays, thereby enabling to perform a preliminary discharge operation for the nozzles in the area where ink is hardly discharged while no ink collects in the cap by a preliminary discharge operation. This enables to complete the preliminary discharge operation before the ink liquid surface rises, thereby preventing back-flow of mixed ink in the cap into the nozzles or entering of bubbles.

In the first to third embodiments, a case in which a preliminary discharge operation for an area where ink is easily discharged starts after completion of a preliminary discharge operation for an area where ink is hardly discharged has been explained. Although the preliminary discharge operation for the area where ink is hardly discharged is not complete, the preliminary discharge operation for the area where ink is hardly discharged starts before that for the area where ink is easily discharged, thereby enabling to obtain the same effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-107037, filed May 8, 2012 and 2013-080841, filed Apr. 8, 2013, which are hereby incorporated by reference herein in their entirety.

What is claimed is:

1. A printing apparatus comprising:

a printhead including a nozzle surface with at least one nozzle array formed by a plurality of nozzles for discharging ink;

a cap member for capping the nozzle surface of the printhead, wherein the cap member includes a suction port for sucking ink from the cap member and an inflow port through which air flows in;

a suction unit connected to the suction port; and a control unit configured to control, in performing an ink preliminary discharge operation for the printhead while driving the suction unit with the nozzle surface capped by the cap member, a start of a first preliminary discharge operation for nozzles, among the plurality of nozzles, with a long distance to a straight line connecting the suction port with the inflow port before a second preliminary discharge operation for nozzles with a short distance to the straight line.

2. The apparatus according to claim 1, wherein the cap member includes an absorber for absorbing ink, and the absorber is arranged so that the surface of the absorber is parallel to the nozzle surface of the printhead when the cap member caps the nozzle surface.

3. The apparatus according to claim 1, wherein the second preliminary discharge operation starts after completion of the first preliminary discharge operation.

4. The apparatus according to claim 1, wherein the second preliminary discharge operation starts before completion of the first preliminary discharge operation.

5. The apparatus according to claim 1, wherein the printhead has a plurality of nozzle arrays, the straight line connecting the suction port with the inflow port is parallel to a direction of an alignment of the plurality of nozzles of each nozzle array, the first preliminary discharge operation is a preliminary discharge operation for a nozzle array, among the plurality of nozzle arrays, away from the straight line, and the second preliminary discharge operation is a preliminary discharge operation for a nozzle array, among the plurality of nozzle arrays, close to the straight line.

6. The apparatus according to claim 1, wherein the printhead has a plurality of nozzle arrays, the straight line connecting the suction port with the inflow port is perpendicular to a direction of an alignment of the plurality of nozzles, the plurality of nozzles of each of the plurality of nozzle arrays are divided into a plurality of areas each including a plurality of neighboring nozzles, the first preliminary discharge operation is a preliminary discharge operation for nozzles in an area, among the plurality of areas, away from the straight line, and the second preliminary discharge operation is a preliminary discharge operation for nozzles in an area, among the plurality of areas, close to the straight line.

7. The apparatus according to claim 1, wherein the inflow port is formed by tilting the cap member with respect to the nozzle surface of the printhead.

8. The apparatus according to claim 1, wherein the printhead has a plurality of nozzle arrays, and the plurality of nozzle arrays respectively discharge inks of different colors.

9. A control method for a printing apparatus which comprises a printhead including a nozzle surface with at least one nozzle array formed by a plurality of nozzles for discharging ink, a cap member for capping the nozzle surface of the printhead, wherein the cap member includes a suction port for sucking ink from the cap member and an inflow port through which air flows in, and a suction unit connected to the suction port, the method comprising:

capping the nozzle surface by the cap member;

driving the suction unit; and performing an ink preliminary discharge operation for the printhead, wherein in the preliminary discharge operation, a first preliminary discharge operation for nozzles, among the plurality of nozzles, with a long distance to a straight line connecting the suction port with the inflow port starts before a second preliminary discharge operation for nozzles with a short distance to the straight line.

10. The method according to claim 9, wherein the cap member includes an absorber for absorbing ink, and the absorber is arranged so that the surface of the absorber is parallel to the nozzle surface of the printhead when the cap member caps the nozzle surface.

11. The method according to claim 9, wherein the second preliminary discharge operation starts after completion of the first preliminary discharge operation.

12. The method according to claim 9, wherein the second preliminary discharge operation starts before completion of the first preliminary discharge operation.

13. The method according to claim 9, wherein the printhead has a plurality of nozzle arrays, the straight line connecting the suction port with the inflow port is parallel to a direction of an alignment of the plurality of nozzles of each nozzle array, in the first preliminary discharge operation, a preliminary discharge operation is performed for a nozzle array, among the plurality of nozzle arrays, away from the straight line, and in the second preliminary discharge operation, a preliminary discharge operation is performed for a nozzle array, among the plurality of nozzle arrays, close to the straight line.

14. The method according to claim 9, wherein the printhead has a plurality of nozzle arrays, the straight line connecting the suction port with the inflow port is perpendicular to a direction of an alignment of the plurality of nozzles, the plurality of nozzles of each of the plurality of nozzle arrays are divided into a plurality of areas each including a plurality of neighboring nozzles, in the first preliminary discharge operation, a preliminary discharge operation is performed for nozzles in an area, among the plurality of areas, away from the straight line, and in the second preliminary discharge operation, a preliminary discharge operation is performed for nozzles in an area, among the plurality of areas, close to the straight line.

15. The method according to claim 9, wherein the inflow port is formed by tilting the cap member with respect to the nozzle surface of the printhead.

16. The method according to claim 9, wherein the printhead has a plurality of nozzle arrays, and the plurality of nozzle arrays respectively discharge inks of different colors.

* * * * *